US006523807B2

(12) United States Patent
Calverley

(10) Patent No.: US 6,523,807 B2
(45) Date of Patent: Feb. 25, 2003

(54) ALUMINUM SHADOW BOX FENCE

(75) Inventor: Anthony R. Calverley, Lantana, FL (US)

(73) Assignee: ARC Specialties, Inc., Lantana, FL (US)

( * ) Notice: Subject to any disclaimer, the term of this patent is extended or adjusted under 35 U.S.C. 154(b) by 0 days.

(21) Appl. No.: 09/822,047

(22) Filed: Mar. 30, 2001

(65) Prior Publication Data

US 2002/0139967 A1 Oct. 3, 2002

(51) Int. Cl.[7] ..... E04H 17/16
(52) U.S. Cl. ..... 256/25; 256/65.08; 256/21
(58) Field of Search ..... 256/21, 22, 59, 256/65, 24, 25, 34, 65.08

(56) References Cited

U.S. PATENT DOCUMENTS

| | | | | | |
|---|---|---|---|---|---|
| 2,511,074 | A | * | 6/1950 | Miller | 52/522 |
| 2,930,638 | A | * | 3/1960 | Morrissey | 256/65 X |
| 3,136,530 | A | * | 6/1964 | Case | 256/22 |
| 3,212,754 | A | * | 10/1965 | Revell et al. | 256/24 |
| 3,276,333 | A | * | 10/1966 | Blok | 256/22 |
| 3,960,367 | A | * | 6/1976 | Rogers | 256/21 |
| 3,963,219 | A | | 6/1976 | D'Amico | |
| 4,053,140 | A | * | 10/1977 | Clemens et al. | 256/19 |
| 4,272,060 | A | * | 6/1981 | Stafford | 256/24 |
| 4,306,631 | A | | 12/1981 | Reusser | |
| 4,312,166 | A | | 1/1982 | Mock | |
| 4,369,953 | A | * | 1/1983 | Greiner et al. | 256/24 |
| 4,461,461 | A | | 7/1984 | Caron | |
| 4,498,660 | A | | 2/1985 | Brema et al. | |
| 4,838,524 | A | | 6/1989 | McKeown et al. | |
| 4,881,355 | A | * | 11/1989 | Bosl et al. | 52/738 |
| 4,964,618 | A | * | 10/1990 | Kennedy et al. | 256/24 |
| 5,149,061 | A | | 9/1992 | Borqnini | |
| 5,301,926 | A | | 4/1994 | Sharp | |
| 5,494,261 | A | * | 2/1996 | Gandara | 256/24 |
| 5,628,495 | A | | 5/1997 | Gandara | |
| 5,938,184 | A | | 8/1999 | DeSouza | |

* cited by examiner

*Primary Examiner*—Lynne H. Browne
*Assistant Examiner*—John R. Cottingham
(74) *Attorney, Agent, or Firm*—David P. Lhota, Esq.; Stearns Weaver Miller Weissler Alhadeff & Sitterson, P.A.

(57) ABSTRACT

A fencing system and method of manufacturing and installing a fencing system specifically designed to give the appearance of a traditional shadow box or privacy fence, wherein the system uses preformed non-corrosive, structurally sound corrugated panels, posts, posts mounts, channel mounts, and clips that mate and are securable using conventional fasteners.

17 Claims, 10 Drawing Sheets

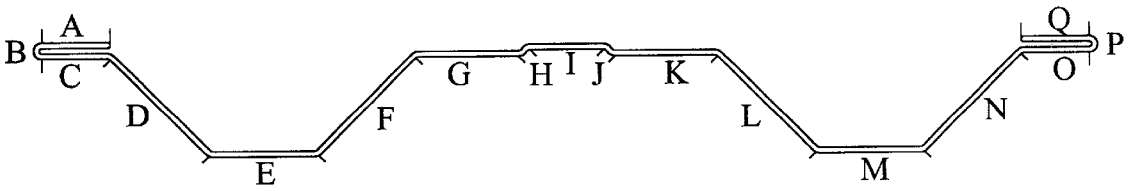

| | | | | | | |
|---|---|---|---|---|---|---|
| A | X Start | 0.75 | X End | 0.3725 | Angle | 180 |
| | Y Start | 2.2025 | Y End | 2.2025 | Length | 0.3775 |
| B | X Center | 0.3725 | Radius | 0.06 | Start Angle | 90 |
| | Y Center | 2.1425 | | | End Angle | 270 |
| C | X Start | 0.875 | X End | 0.3725 | Angle | 180 |
| | Y Start | 2.0825 | Y End | 2.0825 | Length | 0.5025 |
| D | X Start | 0.875 | X End | 1.312 | Angle | 127.87498 |
| | Y Start | 2.0825 | Y End | 1.52 | Length | 0.71261 |
| E | X Start | 1.1312 | X End | 2.1875 | Angle | 0.0 |
| | Y Start | 1.52 | Y End | 1.52 | Length | 0.875 |
| F | X Start | 2.1875 | X End | 2.625 | Angle | 52.12502 |
| | Y Start | 1.52 | Y End | 2.0825 | Length | 0.71261 |
| G | X Start | 2.625 | X End | 3.0625 | Angle | 0.0 |
| | Y Start | 2.0825 | Y End | 2.0825 | Length | 0.4375 |
| H | X Start | 3.0625 | X End | 3.125 | Angle | 45 |
| | Y Start | 2.0825 | Y End | 2.145 | Length | 0.08839 |
| I | X Start | 3.125 | X End | 3.875 | Angle | 0.0 |
| | Y Start | 2.145 | Y End | 2.145 | Length | 0.75 |
| J | X Start | 3.875 | X End | 3.9375 | Angle | 135 |
| | Y Start | 2.145 | Y End | 2.0825 | Length | 0.08839 |
| K | X Start | 3.9375 | X End | 4.375 | Angle | 0.0 |
| | Y Start | 2.0825 | Y End | 2.0825 | Length | 0.4375 |
| L | X Start | 4.375 | X End | 4.8125 | Angle | 127.87498 |
| | Y Start | 2.0825 | Y End | 1.52 | Length | 0.71261 |
| M | X Start | 4.8125 | X End | 5.6875 | Angle | 0.0 |
| | Y Start | 1.52 | Y End | 1.52 | Length | 0.875 |
| N | X Start | 6.125 | X End | 5.6875 | Angle | 52.12502 |
| | Y Start | 2.0825 | Y End | 1.52 | Length | 0.71261 |
| O | X Start | 6.125 | X End | 6.6275 | Angle | 0.0 |
| | Y Start | 2.0825 | Y End | 2.0825 | Length | .5025 |
| P | X Center | 6.6275 | Radius | 0.06 | Start Angle | 90 |
| | Y Center | 2.1425 | | | End Angle | 270 |
| Q | X Start | 0.75 | X End | 0.3725 | Angle | 180 |
| | Y Start | 2.2025 | Y End | 2.2025 | Length | 0.3775 |

FIG. 18

ALUMINUM SHADOW BOX FENCE

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates generally to a fence panel and a fence assembly system, and more particular to a contoured metal fence panel of symmetrical proportions and fence assembly system having mechanically cooperating parts that facilitates convenient and fast fence construction similar to a shadow box design.

2. Description of the Background Art

Wood fences and shadow box designs for wood fences are known in the art. However, weather conditions affect the appearance and structural integrity of wood fences over time. Fences constructed from alternative materials, such as aluminum and plastic, based material, are resistant to inclement weather, last longer and easily maintained, but are not available in shadow box or other panel-like designs and can not be easily customized. Rather, the typical aluminum fence comprises a prefabricated railing apparatus having a top and bottom rail and a plurality of posts bridging the top and bottom rails. Other metal fences known include horizontal panels that fit into post slots and various structure for joining vertical panels between two rails. The metal fences known can be difficult to construct, offer little options in design, such as shadow box and privacy designs, and are relatively expensive. If a metal fence device and system could address these gaps in the prior art, such a fence design would be easier and quicker to construct than conventional wood fence designs and would be well received.

Various fence designs are known in the art, but none of these addresses or solves the above-noted problems associated with metal fence designs and construction. For instance, U.S. Pat. No. 3,963,219 discloses an aluminum fence having a plurality of horizontally disposed panels and a plurality of support posts having slots for receiving the ends of the panels. U.S. Pat. No. 4,306,631 discloses a noise barrier wall and mounting assembly comprising posts, top and bottom girts and a plurality of vertically disposed panels that fit between and within the girts. U.S. Pat. No. 4,312,166 discloses a wall assembly comprising walls having connecting elements that interlock to join adjacent wall panels. U.S. Pat. No. 4,461,461 discloses a non-corrosive security railing comprising a lower railing and upper railing have holes for receiving vertical railing elements, posts formed by laminating a first pipe and second pipe and conventional connectors. U.S. Pat. No. 4,498,660 discloses a modular fence structure comprising modular panels having a rail portion and connector at each end for concentrically mounting over posts. U.S. Pat. No. 4,838,524 discloses a noise barrier system comprising a front corrugated panel, a rear corrugated panel, a central corrugated panel and noise absorbing material separating the panels. U.S. Pat. No. 5,149,061 discloses a panel for road construction comprising a plurality of interlocking panels and a base that mounts to a central road barrier. U.S. Pat. No. 5,301,926 comprises a prefabricated simulated wrought iron fencing system comprising iron fence rails, floor-anchored posts and T-connectors. U.S. Pat. No. 5,628,495 discloses a metal fence structure comprising corrugated panels, lateral stiffeners, posts and fasteners for securing the panel assemblies. U.S. Pat. No. 5,938,184 discloses a plastic fence construction comprising top, bottom and middle rails, channels defined by the rails for receiving panels, posts, and connectors for securing the rails to the posts. The patents found failed to disclose or suggest all the elements of the instant invention, such as C-channels, post mounts and panels as contemplated by the instant invention.

As the above noted art fails to provide a fencing system that can be easily installed, is made of a non-corrosive material, provides for a shadow box or privacy fence appearance, and is structurally durable, there exists a need for such a fencing system. In addition, the method of forming the fencing material remotely from the job site is another unique and novel characteristic of the present invention. The method allows panels to be delivered to the job site ready for convenient installation. The instant invention address the foregoing by providing a fencing system as described herein.

BRIEF SUMMARY OF THE INVENTION

Based on the foregoing, it is a primary object of the instant invention to provide a fence system that is constructed for easy installation and method of manufacturing the same.

It is also an object of the present invention to provide a cost effective means for providing and erecting a fencing system.

It is another object of the present invention to provide a fence system that may be customized for shadow box or privacy designs.

It is a further object of the present invention to provide a fencing system that can be installed by a person without experience in fence installation.

It is an additional object of the instant to provide a unique panel design for use in shadow box or privacy fence construction.

It is yet another object of the instant invention to provide panels that may be interlocked.

Another object of the invention is to provide a method for the production of the fencing system that is flexible and cost effective.

A further object of the instant invention is to provide a method for installing a shadow box or privacy fence using the fence system of the instant invention.

In light of these and other objects, the fence system of the instant invention preferably comprises a plurality of posts, corrugated panels, post mounts and lateral channel mounts. The posts are secured in the ground at a distance and in a manner that can securely support the weight of the post mounts, channels and panels, as well as external forces. Two post mounts are preferably slid over and secured to the posts proximal the top and bottom of the posts, respectively, using conventional hardware. The lateral channel mounts are secured to corresponding post mounts in a manner that bridges the two posts for receiving the panels. The panels comprise a corrugated construction and substantially symmetrical design and are secured vertically to the channel mounts at predetermined distances using conventional hardware. The panels are preferably constructed from a sheet-like aluminum, with specific bends to create a corrugated look and to allow the installation of a shadow box or privacy fence that is strong, uniform and aesthetically pleasing. The panels can comprise various lengths and widths, heights and looks. The edges of the panels may include a bend across the length of the panel for directly or indirectly interlocking adjacent panels, providing a smooth reinforced edge and facilitating proper panel spacing. Thus, the invention may further include clips for interlocking adjacent panels. The clips may be relatively short or long and wide or narrow to achieve a shadow box or privacy design. The components of the fence panel system are preferably made from a non-corrosive, malleable material such as aluminum, stainless steel, plastic based materials, fiberglass material or alternative materials exhibiting non-corrosive, water resistant and durable characteristics.

The system and method of the invention provides the installer with an easy to install fencing system designed to meet standard installation requirements. Moreover, the use of the fencing system will save time and money during the installation process. This is an import object of the present invention.

The instant invention further comprises methods for making the fence panels and installing the fence of the instant invention. The method for making fence panels includes taking a malleable sheet-like material, as described herein, feeding it through a series of rollers that create a symmetrical corrugated panel with at least two crests. The preferred method of installation comprises obtaining the posts, post mounts, channels and panels that comprise the system of the invention, securing the post in a ground or floor like surface, securing two post mounts to each post, bridging the distance between the posts with lateral channel mounts secured to the post mounts near each end, resulting in the fence system frame, and securing the panels to the frame with our without a gap there between. The method of installation may further comprise the use of clips for uniformly controlling the distance or lack thereof between the panels and/or to facilitate a shadow box or privacy fence design.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 18 is an end view and tabular depiction of the relative section sizes and angles of the preferred panel of the instant invention.

DETAILED DESCRIPTION OF THE INVENTION

Figure 1:
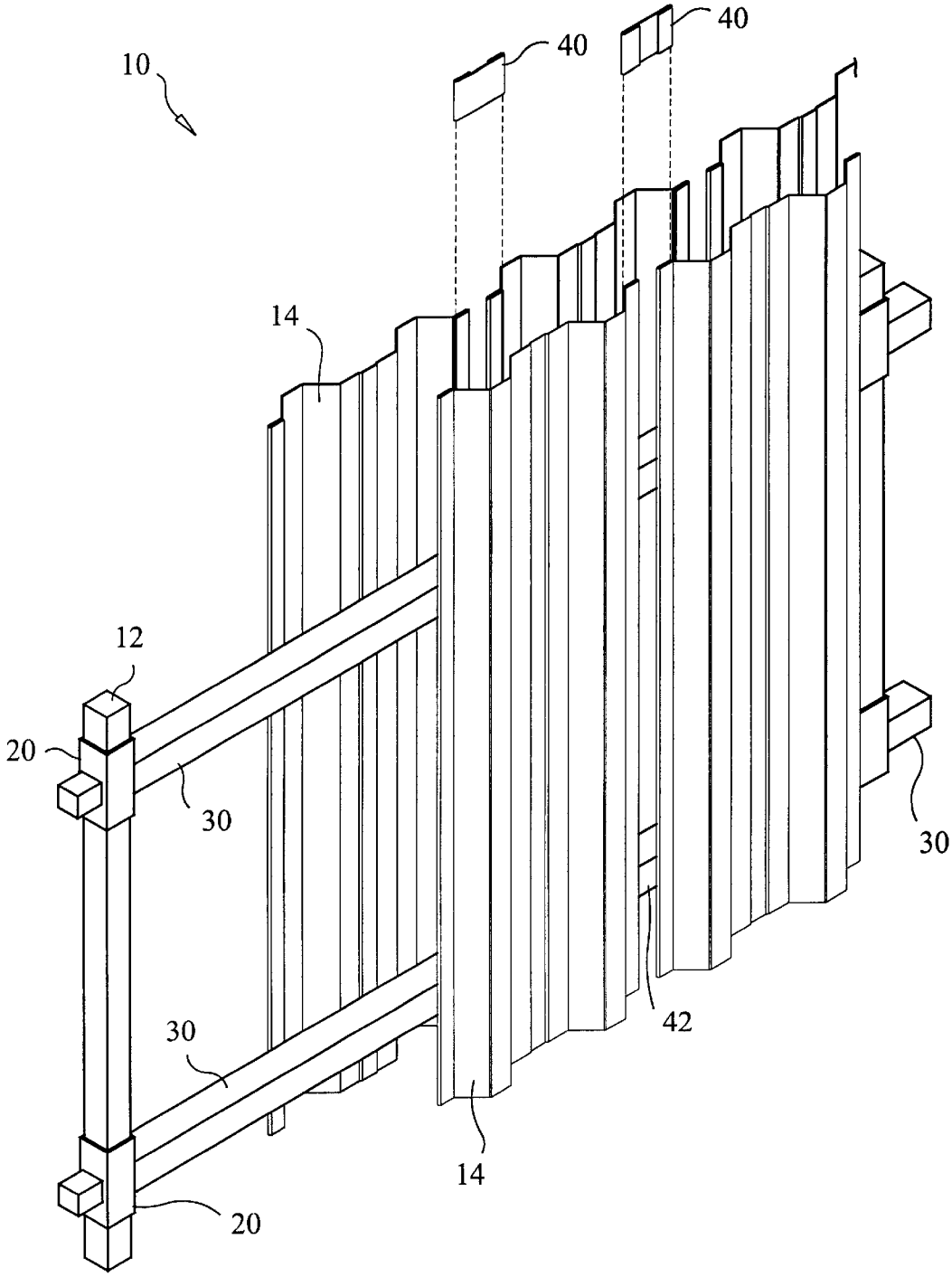
FIG. 1 is a front perspective view of the preferred embodiment of the fence panel system of the instant invention arranged in a shadow box design.

With reference to the drawings, FIGS. 1–18 depict the preferred alternative embodiments of the instant invention, which is generally characterized by numeric character 10 and/or as a fence or fence system. Referring to FIG. 1, the Fencing System 10 preferably comprises a plurality of Posts 12, Panels 15, Post Mounts 20 and Channel Mounts 30. The Fencing System 10 is designed to provide an economical, functional, easy to install and customizable fence, such as shadow box or privacy designs. The Posts 12 are preferably rigid and square or rectangular in cross section to provide a flat outside securing surface for structural integrity and can comprise lengths that confirm with recognized standards in the industry, such as eight feet, or lengths that comport with local building codes. The Posts 12 are securable in a ground or ground like surface, such as with cement or dirt, and can comprise a substantially non-corrosive, waterproof and durable material. The preferred material comprises aluminum or an aluminum based product, or alternatively may comprise plastic, plastic based or fiberglass type materials. The Post Mounts 20, shown in detail in FIG. 8, slide over the Post 12 and are securable thereto using conventional fasteners, such as screws, nuts and bolts and the like. The Post Mounts 20 preferably fit snuggly over the Post 12 to prevent chattering while providing stability in the fence structure. As shown in FIG. 1, a Channel Mount is secured to the Post Mount to provide a lateral support surface for affixing the Panels 14. The Channel Mounts 30 extend between two posts per section of fence to provide a lateral support surface for securing the Panels 14. Each fence section preferably employs two (2) Posts 12, two (2) Post Mounts 20 securely affixed to each post, two (2) Channel Mounts 30 laterally extending between the Posts 12 and secured to corresponding Post Mounts 20 and a plurality of Panels 14 vertically secured to the Channel Mounts 30 and/or Post Mounts 20. As shown in FIG. 1, Short Clips 40 may be used to secure and properly space adjacent Panels 14 and to assist in preventing chattering of the Panels 14. The Short Clips 40 are preferably used in a shadow box design in a manner that does not comprise the shadow box look.

Figure 2:
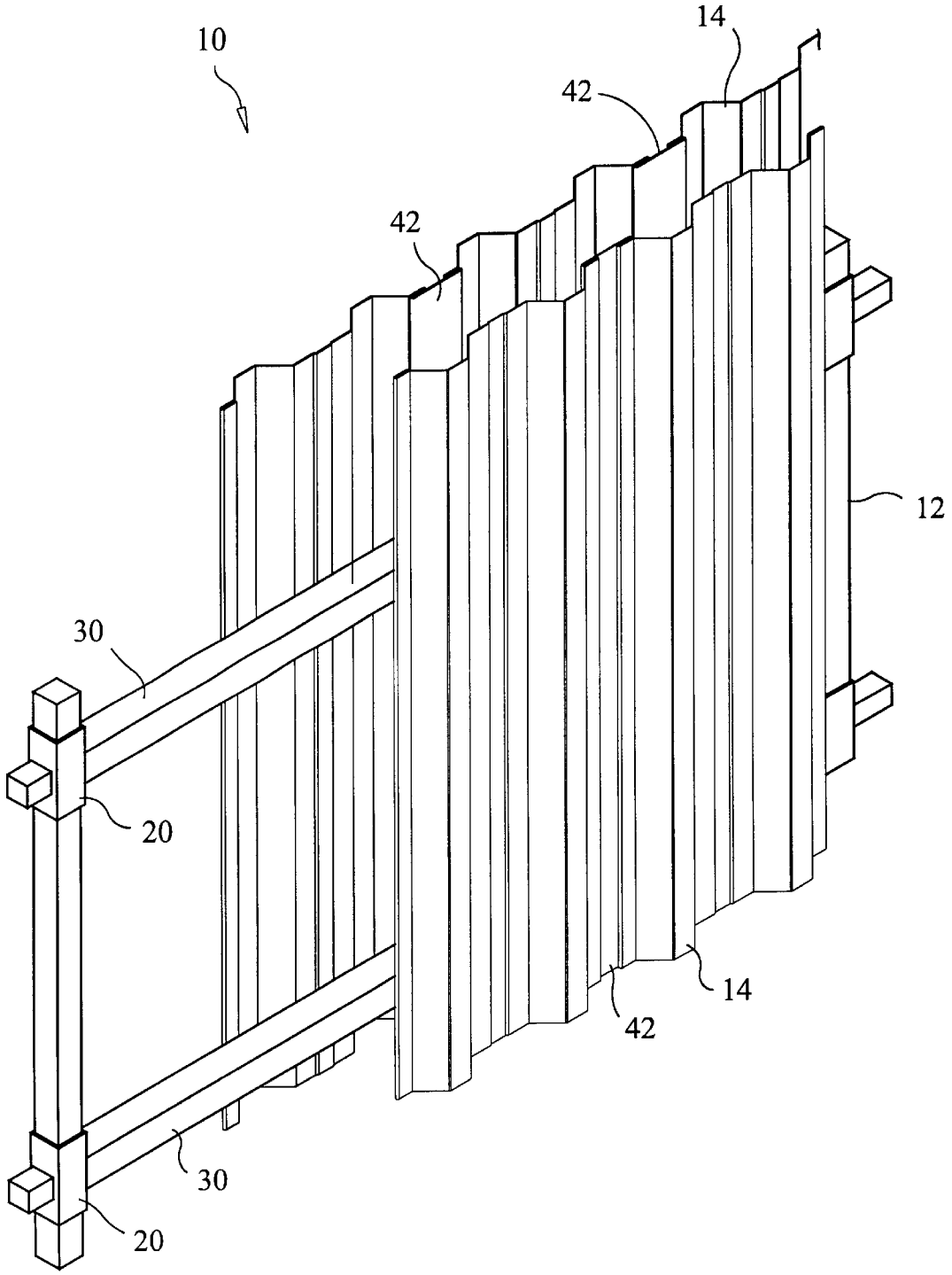
FIG. 2 is a front perspective view of the preferred embodiment of the fence panel system of the instant invention arranged in a privacy design.

With reference to FIG. 2, a fence section of the instant invention 10 is shown in a privacy design. As in the preferred embodiment, each section of fence preferably includes two (2) Posts 12 spaced apart at a predetermined distance, two (2) Post Mounts 20 per post, two (2) Channel Mounts 30 laterally bridging the post and connected to corresponding Post Mounts 20 and a plurality of Fence Panels 14 affixed to the Channel Mounts and/or Post Mounts 20 in a manner that eliminates gaps between the Panels 14. In one embodiment, the. Panels 14 in the privacy design may be juxtaposed such that there is no space there between. In this design, additional stability and security may be provided by employing either the Small Clips 40 or Large Clips 42 to keep the panels joined together. In another embodiment, the Large Clips 42 may be used to secure the Panels 14 while filling the space between adjacent Panels so as to eliminate any gaps there between.

Figure 3:
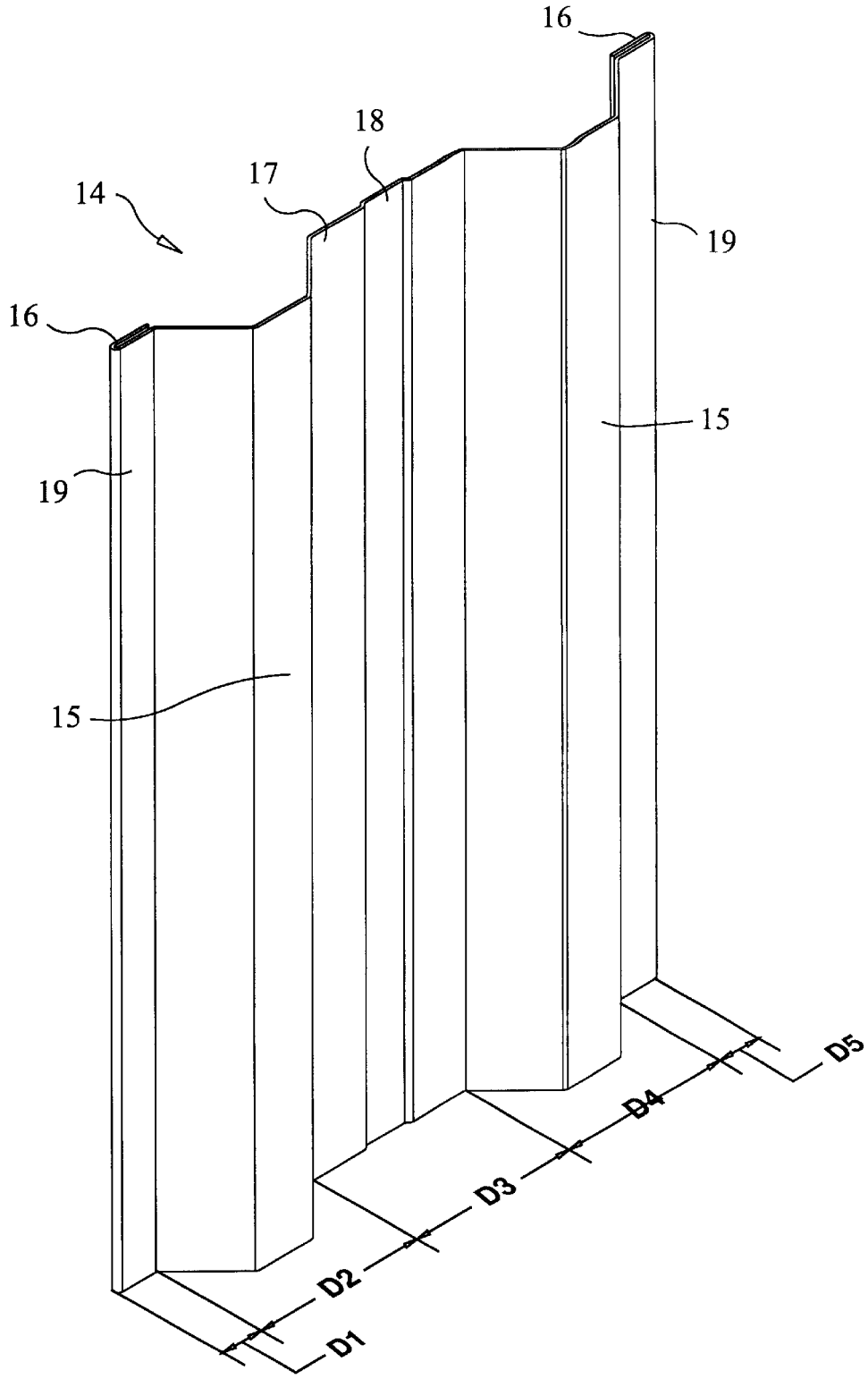
FIG. 3 is a front perspective view of the preferred embodiment of a fence panel in accordance with the instant invention.
Figure 14:
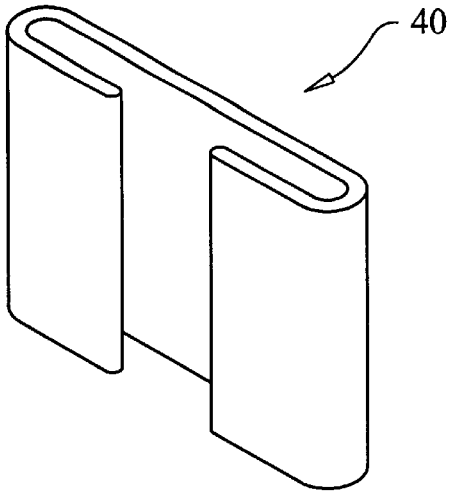
FIG. 14 is a perspective view of the preferred embodiment of the short clip used in the instant invention.

With reference to FIG. 3, a typical Fence Panel 14 is shown. The Fence Panel 14 comprises at least one and preferably two Crests 15, an intervening Panel Trough 17, a Trough Channel 18 and at Edge Segments 19 which form Flange 16. The Crests 15 preferably rise above opposite edges of the Panel Trough 17 so as to define the Trough Section 17. The Crests 15 are preferably trapezoidal in shape, but, may vary. The Panel Trough 17 is preferably defined by the valley formed between opposing Crests 15. The Edge Segments 19 are defined on opposite outside edges of the Crests 15, which define the overall width of a particular Panel 14. Each Edge Segment 19 defines a Flange 16. The Flange 16 is formed by folding a segment of the Edge Segment 19 over itself such that the folded section is substantially in parallel with the remaining Edge Segment 19, as shown in FIG. 3. The Flange 16 enhances the structural integrity of the Panel 14 at the Edge Sections 19, provides a smooth finished edge and creates a dimensional characteristic in the Fence 10 that facilitates proper spacing between the Panels 14 in a shadow box design. The Flanges 16 also provide structure for securely interlocking adjacent Panels 14. As shown in FIG. 3, the panels 14 are substantially uniform and symmetrical. Segment D1 is equal to segment D5 and segments D2, D3 and D4 are equal. In the preferred embodiment, D1 and D5 are equal to one-fourth (¼) of D2, D3 and D4. In the preferred embodiment, as shown in FIG. 3, a Small Clip 40 is preferably used to interlock adjacent Panels 14. The Short Clips 40, as shown in FIG. 14, can be used to secure adjacent Panels 14 to prevent or alleviate chatter while providing uniform spacing between Panels 14 throughout the Fence 10. Alternatively, the Clips 40 may be used to securely abut adjacent Panels 14 for a privacy-like design that eliminates all gaps between the panels. Still referring to FIG. 3, the preferred Fence Panel 14 has approximately five (5) well defined segment dimensions that create a uniform and substantially symmetrical panel. The segments designated D1 and D5 are equal and comprise approximately ¼ the dimensions of D2, D3 and D4, respectively. The panel sections designated. D2, D3 and D4 are each equal in width and are four times the dimension of D1 and D5. These comparative dimensions may vary without departing from the main teachings of the instant invention.

The Panel 14 also includes a Trough Channel 18 extending between the upper and lower ends of the Panel 14 and essentially located within the Trough 17. The Trough Channel 18 is recessed into and below the Trough 17 to achieve uniform across the fence in comparison to the pre-designed gaps between adjacent Panels 14. That is, the width of the Trough Channel 18 is intended to coincide with the width of the gap left between adjacent Panels 14 secured to the Fence 10. This uniform look can be achieved in either a privacy or a shadow box fence design depending on the clips employed. For instance, in a shadow box design, the Small Clips 40 would be used so as to maintain the look of a gap between adjacent panels. Conversely, in a privacy fence design, a Large Clip 42 would be used to fill in the gap from the top edge to the bottom edge between adjacent panels so as to securely join two panels at a predetermined distance while filling in the gap there between. Accordingly, the Clips 40 and 42 have a width and dimensions that facilitate proper spacing between adjacent Panels 14 in a manner that coincides with the width of the Trough Channel 18.

Figure 4:
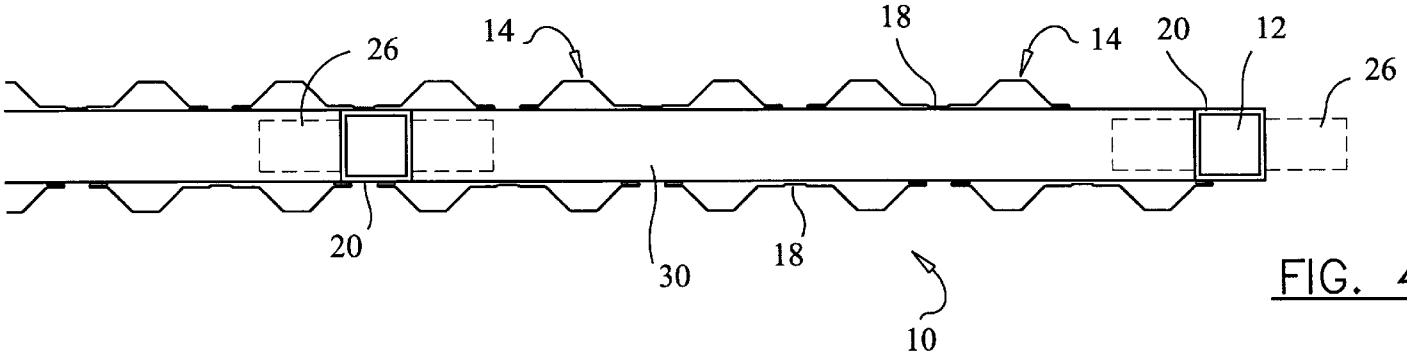
FIG. 4 is a plan view of a fence panel system of the instant invention.
Figure 5:
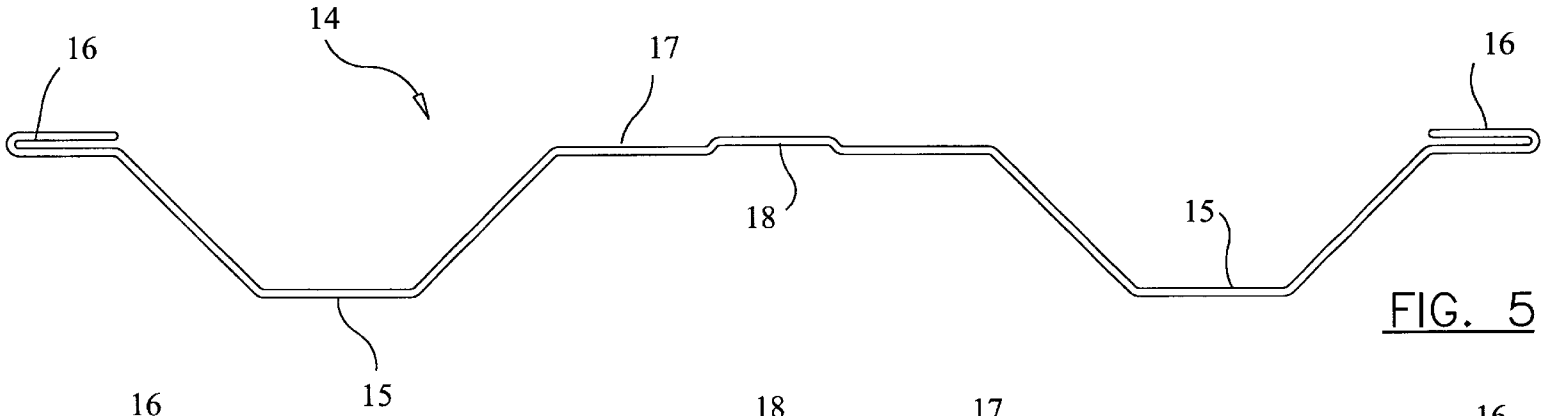
FIG. 5 is an end view of the preferred fence panel of the instant invention.

With reference to FIG. 4, the preferred Fence System 10 is shown in a plan view. As shown, the Panels 14 are preferably affixed to the Channel Mount 30 and/or Post Mount 20 on both sides using conventional fasteners. As shown, a Gap 11 is left between adjacent panels. The Gap 11 preferably has a width that is substantially equal to the width of the Trough Channel 18 to achieve a uniform, look. As shown in FIG. 4, the Channel Mounts 30 are securely mounted to the Post Mounts 20 in a manner that facilitates the secure attachment of Panels 14. The small clips 40 may be used for securing the panels 14 while facilitating a shadow box look. The large clips 42 may be used for facilitating a privacy fence design.

Figure 6:
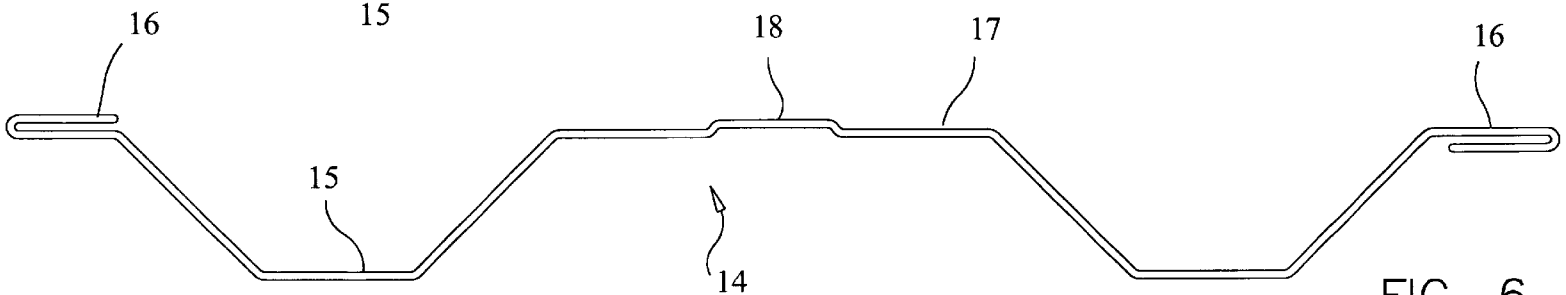
FIG. 6 is an end view of an alternative fence panel of the instant invention.

With reference to FIG. 6, alternative panel designs are shown. Referring to FIG. 6, an end view of the preferred Panel 14 is shown, illustrating flanges, which bend inward behind the Edge Segments 19. With reference to FIG. 6, an alternative Panel 14' is shown. The alternative Panel Design 14 Prime comprises a First Flange 16 which bends behind Edge Segment 19 as previously described and an alternative Flange 16' bends over and in front of the opposite Edge 19. This alternative Panel Design 14' allows adjacent Panels 14 to be directly interlocked to create a privacy fence design. It should also be noted that although Panels 14 are shown as being secured to both sides of a Fence Structure 10, the Panels 14 may be secured to only one side of the Fence 10.

Figure 7:
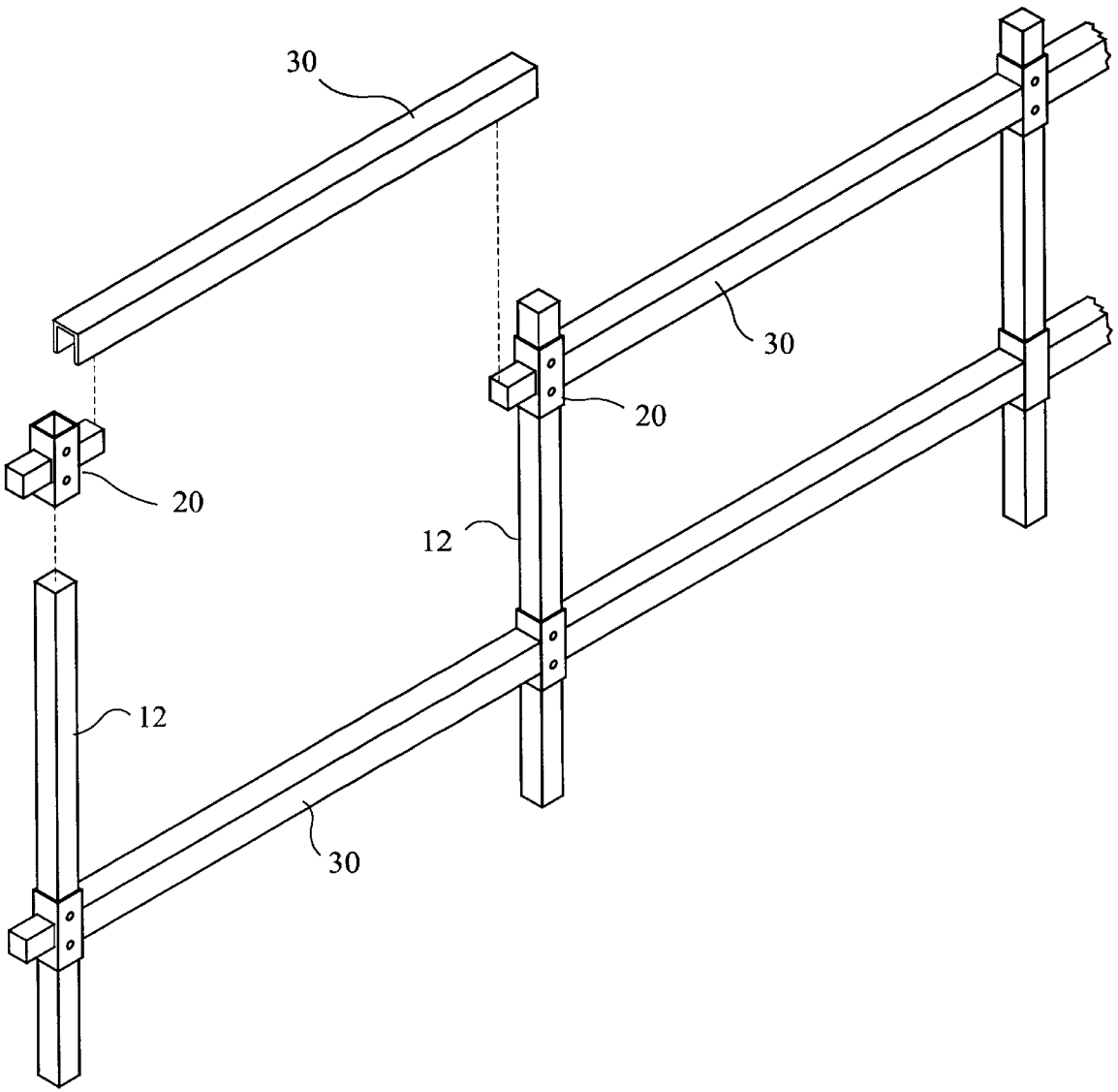
FIG. 7 is a front perspective view of the preferred embodiment of the fence panel assembly of the instant invention, that is with the fence panels removed.

Referring to FIG. 7, a typical fence frame in accordance with the instant invention is shown. The fence frame basically comprises at least one pair of Posts 12, two Post Mounts 20 securely mounted to each Post 12, and a Channel Mount 30 securely mounted and affixed to opposing Post Mounts 20 positioned at corresponding levels on the Posts 12. The Post Mounts 20 and Channel Mounts 30 may be securely fastened using conventional fasteners. The fence frame provides a chassis for securely affixing the Panels 14 thereto.

Figure 8:
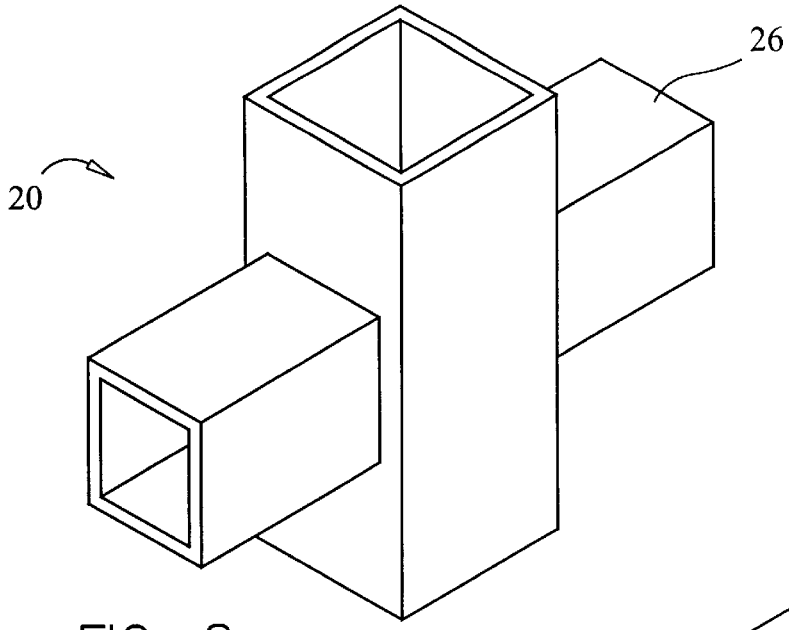
FIG. 8 is a perspective view of the preferred post-mount of the instant invention.

With reference to FIG. 8, a preferred Post Mount 20 is shown. The preferred Post Mount 20. comprises a Post Sleeve 22 defined by four Sidewalls 23, a Post Barrel 24 defined by the interior surfaces of the Sidewalls 23 and two Channel Ledges 26 projecting outward from opposite Sidewalls 23. The Post Mounts Barrel 24 defines a shape and dimensions that coincide with the Post 12 for facilitating a snug fit therewith to eliminate chattering. The Post Mounts 20 are preferably secured to Posts 12 using conventional hardware, such as screw or bolt fasteners. At least two fasteners per Sidewall 23 are preferred. In an alternative embodiment, the Post Mounts 20 may be secured by cooperating latches, snaps and/or dimples found on or formed in the Posts 12 and Post Mounts 20. The preferred Channel Ledge 26 comprises lateral projections that extend outward from opposite Sidewalls 23 of the Sleeve 22. The Channel Ledge 26 preferably has a square or rectangular cross section that facilitates a mating, and preferably snug, connection with the Channel Mount 30. In an alternative embodiment, the Channel Ledge 26 may comprise an upwardly oriented "U" shaped channel for receiving the Channel Mounts 30. In this embodiment, the Ledger 26 would preferably have drainage ports for draining collected water, such as rain. The alternative design can conceal the hardware used for securing the Channel Ledge 26 and Channel Mount 30 to alleviate the risk of injury.

Figure 9:
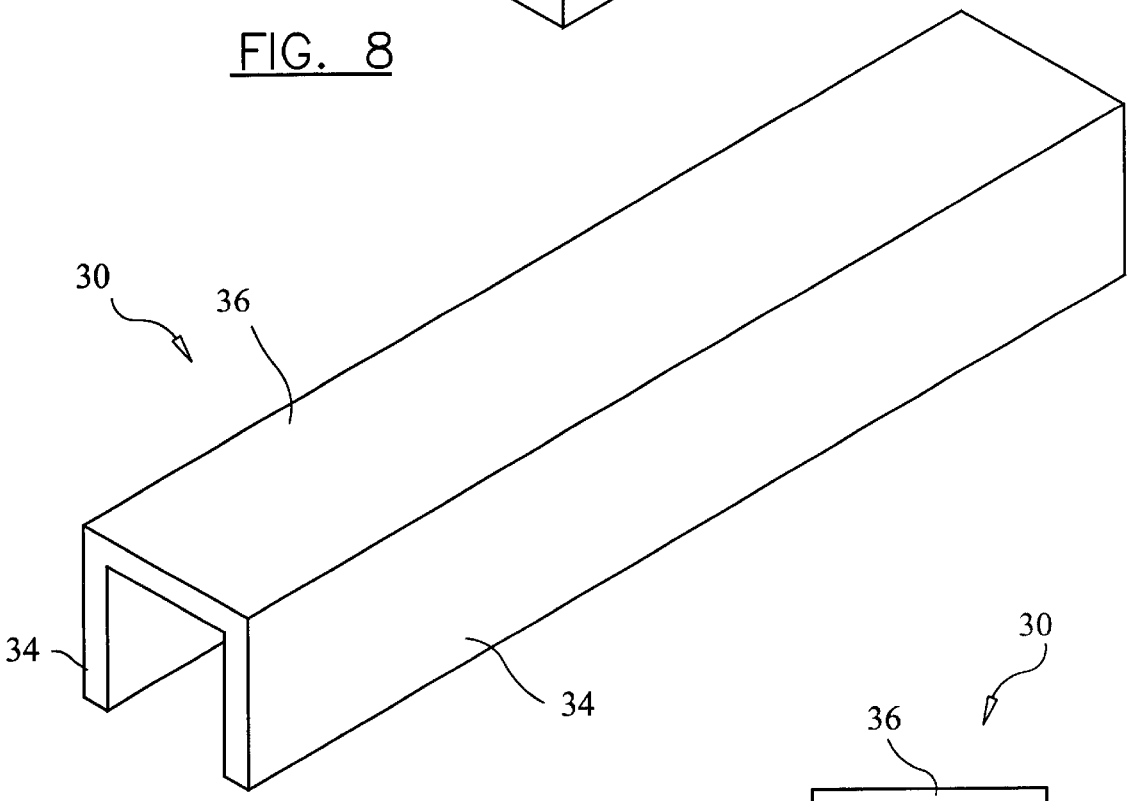
FIG. 9 is a perspective view of the preferred embodiment of the channel mount of the instant invention.

With reference to FIG. 9, the preferred Channel Mount 30 is shown and comprises two opposing Sidewalls 34 depending from a Top Wall 36. The Sidewalls 34 and Top Wall 36 form a channel adapted for snugly mounting over the Post Mount Ledges 26. Thereafter, the Channel Mounts 30 may be secured with conventional hardware, such as screw or bolt fasteners. Alternatively, the Channel Mounts 30 may be secured to the Ledges 26 by cooperating latches, snaps and/or dimples found on or formed in the mounts 30 and ledges 26. The Channel Mount Ends 32 preferably abuts the Post Mounts 20 to maximize the support of the ledge 26. In an alternative embodiment, the Channel Mounts 30 may comprise a square or rectangular cross section that facilitates mating, and preferably snugly, with the alternative post ledges 26.

Figure 10:
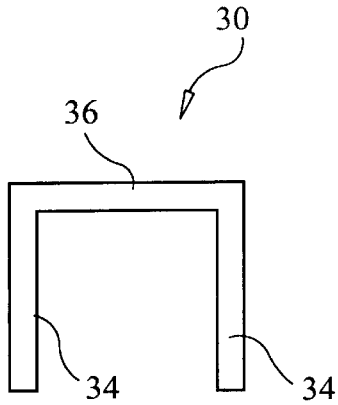
FIG. 10 is an end view of the preferred embodiment of the channel mount of the instant invention.

With reference to FIG. 10, an end view of the Channel Mount End 32 is shown and comprises a substantially "U" shaped configuration. The Channel Mount 30 defines a channel of a predetermined width between the Sidewalls 32 that corresponds to the width of the Channel Ledge 26. The Channel Mount Sidewalls 34 preferably have a height that corresponds to the height of the Channel Ledge 26 for completely enclosing the Channel Ledge 26 within a corresponding end of a Channel Mount 30. In alternative embodiments, the Channel Ledge 26 and corresponding Channel Mount 30 may comprise cross-sectional dimensions and shapes that are other than rectangular or square. However, a square or rectangular cross-section is desired for enhanced structural integrity. The Channel Mounts 30 may further comprise drainage ports, if necessary, for draining collected water, such as rain.

Figure 15:
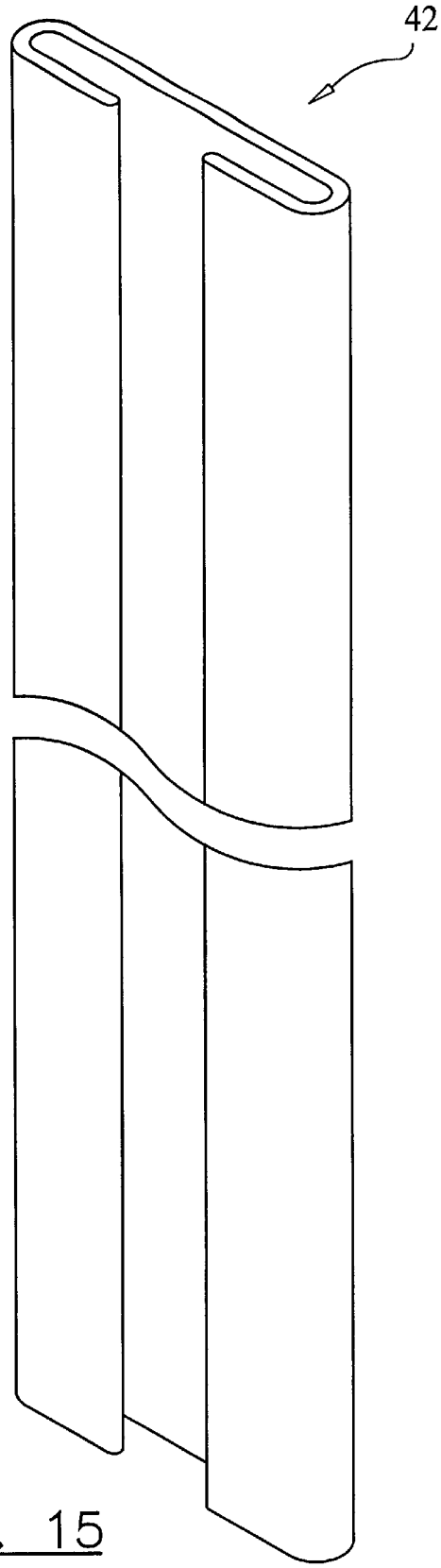
FIG. 15 is a perspective view of the preferred embodiment of the long clip used in the instant invention.
Figure 16:
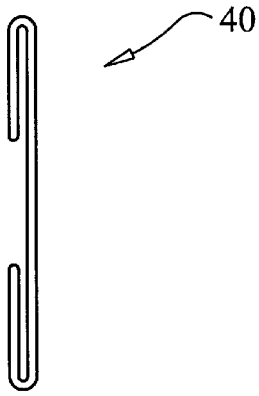
FIG. 16 is an end view of the preferred clip used in the instant invention.

With reference to FIGS. 14–16, the preferred securing Clips 40 and 42 are shown. In one embodiment, the securing clip comprises a Small Clip 40 that is primarily used for shadow box like designs. In a privacy fence design, the Large Clip 42 is preferably used to completely close off any gap between adjacent Panels 14. The Small and Clips 40, 42 both comprise the folded edges that defined flanges corresponding to the Panel Flanges 16 as defined by the Panels 14. Accordingly, the thickness of the flanges defined by the Clips 40, 40 correspond to the gap defined by the Flanges 16 and the Panels 14. The Clips 40 or 42 are installed by aligning a clip end with opposing Flanges 16 of adjacently positioned Panels 14. If the smaller Clip 40 is used, it is preferably slid down over the Flanges 16 into alignment with the Channel Mount 30. The larger Clip 42 has a length that coincides with the length of the Panels 14, such that when the large clip is engaged with adjacent Panels 14 it will substantially fill in the gap between adjacent panels between the top and lower ends.

The Panel Edges 19 and Flanges 16 provide a folded edge or hem edge that increases the rigidity of the panels and aides in reduction of chatter. Moreover, the Edge and Flange Segments 19, 16 provide a smoother edge that is easier to handle during installation. Without a folded hem edge as depicted by the Flange 16 of the Panels 14, wind passing through the fence 10 could cause unwanted vibration and chatter. This is alleviated by the Panel Flanges 16.

The instant invention further comprises methods for making the Fence Panels 14 of the instant invention and for installing the Fence 10 of the instant invention. The process of forming Fence Panels 14 comprises determining the appropriate panel size for field installation given the various design perimeters of the fence to be constructed. However, the present invention may also contemplate manufacturing standard size Panels 14 that could be modified in the field during installation. The method of forming Panels 14 further comprises choosing the appropriate fencing material to be fed into a bending machine, which preferably comprises aluminum, or other suitable non-corrosive, waterproof and durable material, such as plastics or fiberglass. The selected sheet for the Panels 14 are then fed through a bending machine which comprises a series or plurality of uniquely designed and positioned rollers to create the bends in the Panel 14. The bending machine of the instant invention 10 preferably comprises a plurality of roller stations or stages, such as five to seven stations, that contribute to the various bends in the Panels 14. With reference to FIGS. 13(*a*) to 13(*f*), a flat sheet of non-corrosive, waterproof material is converted into the corrugated Panel 14. Referring to FIG. 13(*a*), a flat sheet of material, preferably aluminum or other stainless alloy, is held down and cut into approximately three or four pieces. The sheet is first given two center bends at or around fifty-percent, as shown in FIG. 13(*b*). In the next stage, the outer bends are kicked out to form approximately thirty-percent of the outer bends in a manner to form a panel edge 19 of a predetermined size, such as two-inches in one embodiment, and to complete the center bends, as shown in FIG. 13(*c*). Referring to FIG. 13(*d*), the next stage increases the outer bends to fifty percent of its desired angle. In one of the later stages, such as stage six, the outer bends are completed to a hundred percent, as shown in FIG. 13(*e*). In one of the last stages, a bend of approximately ninety degrees is made in the panel edge 19 and thereafter, the Flange 16 is completed by forcing the panel edge 19 inward to close the hem edge using a cam and cam system.

Figure 11:
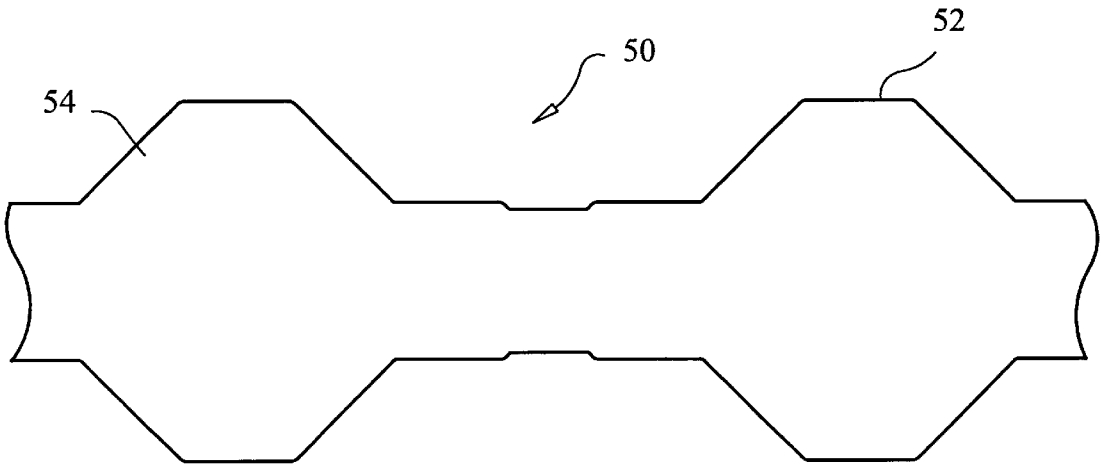
FIG. 11 is an elevational view of the preferred embodiment of the first roller of the machine used in the process of making the panels.
Figure 12:
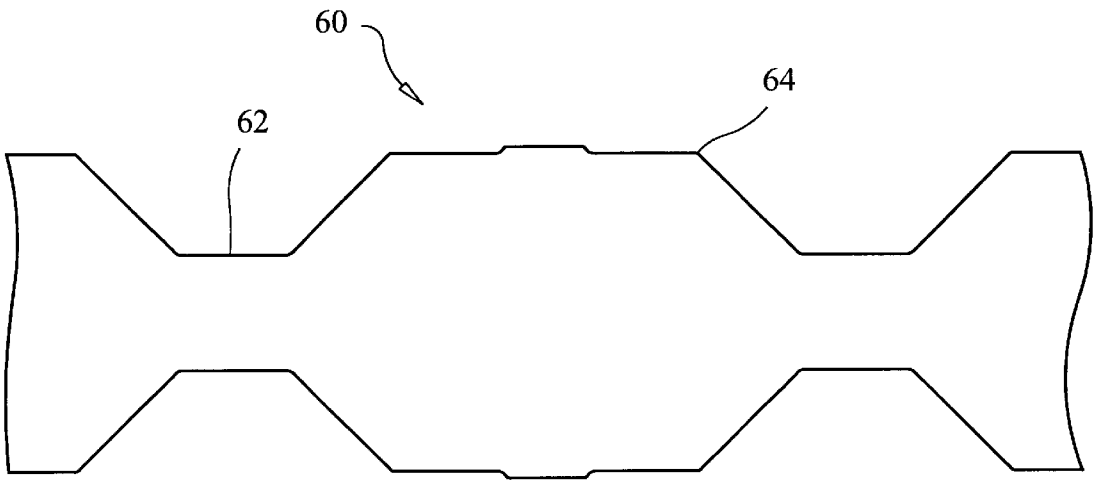
FIG. 12 is an elevational view of a second roller corresponding to the first roller of the machine used in the process of making the panels.
Figure 13A:
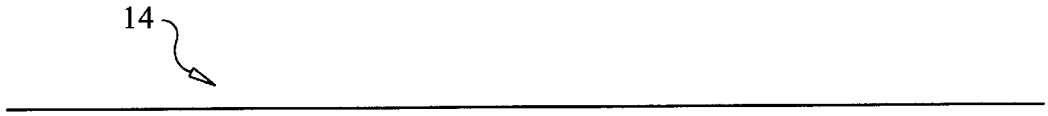
FIGS. 13A–13E are graphical illustrations of the preferred panel as it is formed in accordance with the instant invention.
Figure 13B:
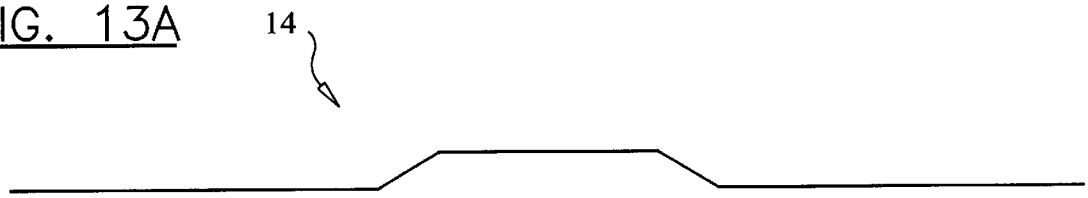
Figure 13C:
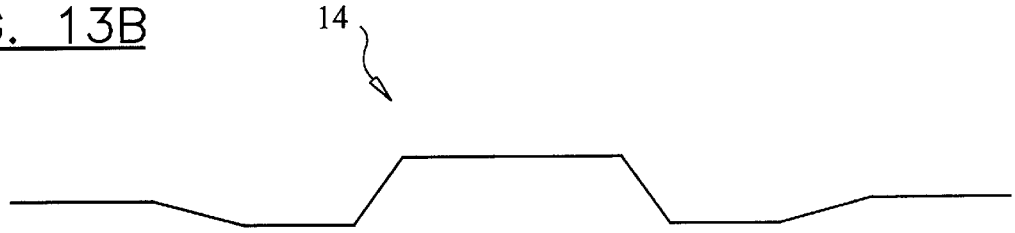
Figure 13D:
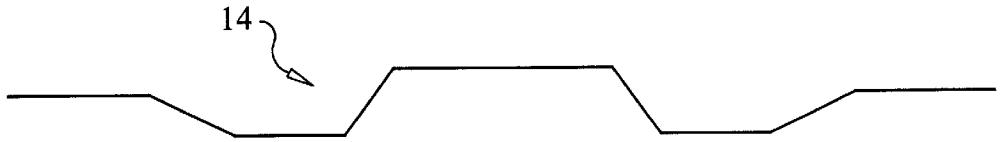
Figure 13E:
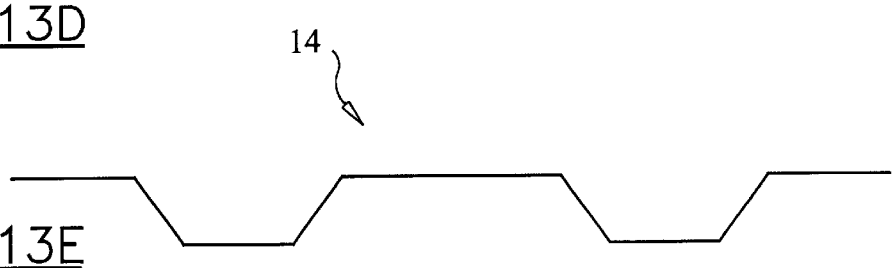

Rollers 50 and 60 are preferably employed to fine tune the bends and channels in the Panel 14, as shown in FIGS. 11 and 12. The First Roller 50, as shown in FIG. 11, comprises Crests Forming Molds 52 and a valley there between having surface dimensions and contours that correspond to the Panel Trough 17 and Trough Channel 18. With reference to FIG. 12, a Cooperating Roller 60 is shown. The Cooperating or Second Roller 60 comprises dimensions that correspond and mate with the First Roller 50, as shown. Thus, the Second Roller 60 defines a Valley 62 that corresponds and mates with the Crests Mounts 52. Likewise, the Second Roller Central Mold 64 and End Molds 66 correspond to the valleys or recessions defined between and outside the Crests Molds 52 as defined by the First Roller 50. The First and Second Rollers 50, 60 are positioned and aligned to receive the Panel 14 therebetween such that the panel is shaped into the corrugated form while passing therethrough. Consequently, the Panel 14 comprises a malleable material for facilitating the formation of the corrugated design.

Referring to FIG. 18, the Panel 14 has various sections with predetermined angles and sizes. These sections are designed to result in a substantially symmetrical Panel 14. The lengths and angles of the various sections, as shown in FIG. 18, may vary so long as the overall structural integrity and look of the Panels 14 are not compromised.

The method of installing the Fence 10 of the instant invention comprises obtaining the Posts 12, Post Mounts 20, Channel Mounts 30 and Panels 14 of the Fence System 10, securing the posts in the ground or ground like surface, securing two (2) Post Mounts 30 to each Posts 12, bridging the distance between the Posts 12 with the lateral Channel Mounts 30, securing the Channel Mounts 30 at each End 32 to the Post Mount Channel Ledges 26 at each end and securing the panels to the frame with or without a gap there between depending on the preferred design. The posts are secured in a ground like surface using conventional methods such as cement and/or dirt. The Post Mounts 20 are slid over the posts, preferably two Post Mounts 20 per Posts 12, and positioned at predetermined levels preferably spaced evenly on the Posts 12 at distances that enhance the structural integrity thereof. The Post Mounts 20 are secured to the Posts 12 using conventional fasteners. The Post Mounts 20 secured to a corresponding Posts 12 should be positioned at corresponding heights for creating a substantially level in the Fence 10. Thereafter, Channel Mounts 30 are mounted over the Post Mount Channel Ledges 26 at each end of the Channel Mounts 30. The Channel Mounts should have a length that bridges completely across and between the Posts 12 and Post Mounts 20. The Channel Mount 30 is secured to the Post Mount Channel Ledges 26 using conventional fasteners. Once the Channel Mounts 30 and Post Mounts 20 have been firmly secured, the installer may begin to affix the Panels 14 to the resulting fence frame assembly. A level line should be drawn across the top of the posts or at least at a level for dictating where the tops of the Panels 14 should terminate. The Panels 14 are secured to the fence assembly using conventional fasteners. The Panels 14 may be positioned on the fence frame with a defined gap there between. In order to more firmly secure the Panels 14 to the fence frame so as to prevent chattering and panel movement, the Small Clips 40 may be employed. To use the Small Clips 40, the method contemplates aligning and sliding the Clips 40 over opposing Flanges 16 of adjacently positioned Panels 14. The Clips 40 would preferably reside in alignment with the Channel Mounts 30 so as to not comprise the shadow box look. In a privacy design, the panels may be placed in touching engagement such that there is no gap there between with or without the use of Small or Large Clips 40, 42. In the preferred embodiment, the privacy design employs the Large Clip 42 for closing the gap between adjacent Panels 14. The Large Clip 42 is aligned and slidably engaged with corresponding Flanges 16 as described in reference to the Small Clips 40; The caps 40 or 42 are installed by mounting them over the panels 14.

Figure 17:
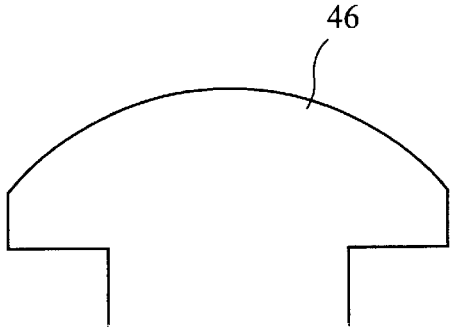
FIG. 17 is an end view of the preferred cap used in the instant invention.

The instant invention may further comprise railing caps, as shown in FIG. 17, to provide a railing system in the Fence System 10. The Railing Caps 80 may be employed to finish off the upper edges of the fence to provide a smooth rail-like finish. The Fence Caps 80 preferably comprise elongated caps that have lengths that correspond to the length of the Channel Mounts 30 and/or the distance between cooperating posts 12, and widths that correspond to the distance between Panels 14 secured on opposite sides of the Channel Mounts 30. Alternatively, the Railing Caps 80 may comprise a plurality of shorter caps that are used to finish off the upper and/or lower edge of the Fence 10.

It should be noted that the instant invention 10 can be employed as a fence system or a railing system. As a fence system, the Posts 12 are preferably secured in the ground. As a railing system, the Posts 12 are preferably mounted to or in a floor-like surface, such as a balcony, stairs or patio.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A substantially rust proof and modular fence system comprising:

at least one corrugated panel having two side edges, a top end and a bottom end; and means for securely supporting said panels in a substantially upright position, said supporting means comprising a post having at least one substantially flat side, a post mount having a sleeve adapted for mating over said post wherein said sleeve has at least one substantially flat interior surface corresponding to said post side for facilitating the secure mounting of said post mount to said post and at least one ledge projecting outward from an outside surface of said sleeve, and at least one channel mount having a depth and adapted for securely mounting to said post mount ledge and for attaching said panels.

2. A system as recited in claim 1, wherein said panels further comprise:

a recessed channel extending substantially between said top and bottom ends for facilitating a uniform look when said panels are positioned adjacently with a space therebetween.

3. A system as recited in claim 1, further comprising:

a clip having side edges and flanges defined by said side edges that mate with said panel side edges for securing said panels and controlling the spacing between adjacent panels.

4. A system as recited in claim 3, wherein said clip is substantially the same length of said panels.

5. A system as recited in claim 3, wherein said clip is substantially the same length as said channel mount's depth.

6. A system as recited in claim 1, wherein said means for securely supporting said panel comprises:

at least one additional post; and said post mount comprising a second ledge projecting outward from said outside surface of said sleeve.

7. A system as claimed in claim 1, wherein said post mount comprises:

a post sleeve defining a passageway having four substantially right angles for mating with said post, said post comprising four substantially right angles that correspond to said sleeve.

8. A system as recited in claim 1, wherein said channel mount has an open side for mounting over said ledge.

9. A system as recited in claim 1, wherein said panels are securable to opposite sides of said channel mount.

10. A system as recited in claim 9, further comprising an elongated cap that mounts over the top end of said panels to fill the space between said panels and for covering the top end of said panels.

11. A system as recited in claim 1, further comprising a cap that is mountable over at least one end of said panels to conceal sharp edges.

12. A system as recited in claim 1, wherein said system comprises a substantially corrosion and moisture resistant alloy based material.

13. A system as recited in claim 1, wherein said system comprises aluminum.

14. A process for installing a fence system comprising:

obtaining elongated, rigid posts, post mounts having a sleeve adapted for receiving said posts and ledges, channel mounts adapted for mating with said ledges and corrugated panels having flanges defined by the side edges;

securing said posts in a surface at predetermined positions;

mounting said post mounts over said posts;

securing said post mounts to said posts;

mounting said channel mounts to said ledges;

securing said panels to at least said channel mounts in a substantially vertical orientation; and installing a clip on two adjacent panels for controlling the spacing therebetween.

15. A process as recited in claim 14, further comprising: mounting at least one cap on the top ends of said panels.

16. A system as recited in claim 1, wherein said panel comprises:

a flange defined by each of said side edges and comprising said side edges being wrapped back over said panel in substantially a parallel orientation, said flanges providing a smooth finished edge for convenient handling, structural reinforcement and structure that may be selectively employed for interlocking adjacent panels.

17. A system as recited in claim 16, further comprising a clip having side edges and flanges defined by said side edges that mate with said panel flanges for securing said panels and controlling the spacing between adjacent panels.

* * * * *